US012117262B2

(12) United States Patent
Coonan

(10) Patent No.: US 12,117,262 B2
(45) Date of Patent: Oct. 15, 2024

(54) THUMBREST FOR HANDGUN

(71) Applicant: Gary M. Coonan, Bell Buckle, TN (US)

(72) Inventor: Gary M. Coonan, Bell Buckle, TN (US)

( * ) Notice: Subject to any disclaimer, the term of this patent is extended or adjusted under 35 U.S.C. 154(b) by 40 days.

(21) Appl. No.: 17/714,925

(22) Filed: Apr. 6, 2022

(65) Prior Publication Data

US 2023/0040664 A1 Feb. 9, 2023

Related U.S. Application Data

(60) Provisional application No. 63/185,052, filed on May 6, 2021.

(51) Int. Cl.
*F41C 23/10* (2006.01)
*F41C 23/04* (2006.01)

(52) U.S. Cl.
CPC ..... *F41C 23/10* (2013.01); *F41C 23/04* (2013.01)

(58) Field of Classification Search
CPC ..... F41C 23/12; F41C 23/04; F41C 27/22; F41C 27/00; F41C 23/16; F41C 23/14; F41C 23/10; F41A 19/07; F41A 11/04; F41G 11/003
USPC ..... 42/72, 90, 71.02, 94, 124, 73, 71.01, 42/75.04; 362/110; 89/148
See application file for complete search history.

(56) References Cited

U.S. PATENT DOCUMENTS 1,372,763 A * 3/1921 Marcq ..... F41A 19/07 42/69.01
1,695,071 A * 12/1928 Villalpando ..... F41A 23/00 42/106
1,812,905 A * 7/1931 Stuyvesant ..... F41A 17/20 89/148
4,271,623 A * 6/1981 Beretta ..... F41C 23/04 42/72
4,555,973 A * 12/1985 Timari ..... F41A 3/72 89/1.4
4,660,311 A * 4/1987 Breitfeld ..... F41C 23/14 42/72
4,735,008 A * 4/1988 Williams ..... F41C 23/10 42/72

(Continued)

OTHER PUBLICATIONS

International Search Report and Written Opinion for corresponding patent application No. PCT/US2022/027425, dated Dec. 23, 2022, 10 pages.

*Primary Examiner* — Michael D David
(74) *Attorney, Agent, or Firm* — Patterson Intellectual Property Law, P.C.; Ryan D. Levy

(57) ABSTRACT

A thumbrest for a handgun is provided, the thumbrest having at least a thumb support and a support base. The support base may be configured for mounting to the handgun. The thumb support may be pivotably movable with respect to the support base or a lateral side of a handgun frame, pivoting between a collapsed position, wherein the thumb support may be folded up adjacent to, or in contact with, the support base or the lateral side of the handgun frame, and an extended position, wherein the thumb support may be pivoted away from the support base or the lateral side of the handgun frame. In other embodiments, a spring may be configured to bias the thumb support toward the extended position, and a stop structure may be configured to limit pivotal movement of the thumb support, such that liming pivotal movement of the thumb support defines the extended position.

20 Claims, 6 Drawing Sheets

(56) References Cited

U.S. PATENT DOCUMENTS 6,901,691 B1 * 6/2005 Little ..... F41G 1/41 42/118
7,111,424 B1 * 9/2006 Moody ..... G03B 17/561 42/72
7,140,138 B1 * 11/2006 Laney ..... F41A 17/74 42/70.08
7,367,152 B2 * 5/2008 Samson ..... F41G 1/00 42/148
7,591,098 B2 * 9/2009 Matthews ..... F41G 11/003 89/200
7,735,255 B1 * 6/2010 Kincaid ..... F41C 33/041 403/374.5
7,823,316 B2 * 11/2010 Storch ..... F41G 11/003 42/127
8,393,104 B1 * 3/2013 Moody ..... F41C 27/00 42/71.01
9,021,734 B2 * 5/2015 Voigt ..... F41A 11/04 42/75.04
9,194,649 B2 * 11/2015 Nierenberg ..... F41C 23/08
10,066,900 B2 * 9/2018 Bowers ..... F41C 23/12
10,619,974 B2 4/2020 Smith et al.
11,187,493 B1 * 11/2021 Teague ..... F41C 23/12
11,549,780 B1 * 1/2023 Henderson ..... F41C 23/12
2012/0167438 A1 * 7/2012 Daniel ..... F41G 11/004 29/525.08
2012/0317854 A1 12/2012 Nierenberg
2013/0333262 A1 12/2013 McClave
2016/0003577 A1 1/2016 Bowers
2016/0146573 A1 * 5/2016 Kunkel ..... F41C 27/22 42/90
2016/0282073 A1 9/2016 Ghitti

* cited by examiner

THUMBREST FOR HANDGUN

CROSS-REFERENCES TO RELATED APPLICATIONS

This application claims benefit of the following patent application which is hereby incorporated by reference: U.S. Provisional Application No. 63/185,052 filed May 6, 2021, entitled "Handgun Improvement Device."

FIELD OF THE DISCLOSURE

The present disclosure relates generally to a handgun improvement device, and more particularly to a pivotable thumbrest for a handgun.

BACKGROUND

A handgun generally includes standard handgun components, including, but not limited to, a handgun frame, a handgun barrel, a handgun grip, and a handgun trigger. In order to fire the handgun, a shooter generally applies a trigger hand about the handgun grip, placing and wrapping a finger of the trigger hand around the handgun trigger to pull the handgun trigger, thereby firing the handgun. The shooter generally applies a non-trigger hand to a lateral side of the handgun frame, in order to stabilize and control the handgun, when the handgun is fired by the shooter. This is accomplished by wrapping the non-trigger hand about an opposite side of the trigger hand applied about the handgun grip, and placing, or resting, a thumb of the non-trigger hand against the lateral side of the handgun frame. Wrapping the non-trigger hand about the opposite side of the trigger hand, which is applied about the handgrip, may form a two-handed grip of the handgun. In a conventional model of the handgun, however, the lateral side of the handgun frame generally does not include a component capable of receiving the thumb of the shooter's non-trigger hand, on which the shooter may securely apply the thumb of the non-trigger hand to the lateral side of the handgun frame during the firing of the handgun.

To aid in a placement of the thumb of the non-trigger hand, a thumbrest, or thumbgrip, may be removably or permanently connected, affixed, mounted, or otherwise attached to the lateral side of the handgun frame. The thumbrest may enable the shooter to place and rest the thumb of the non-trigger hand, such that the non-trigger hand is wrapped about the opposite side of the trigger hand and along the lateral side of the handgun frame. In applying a force through the thumb of the non-trigger hand against the thumbrest, the shooter may exert greater control and grip of the handgun. By applying the force through the thumb of the non-trigger hand against the thumbrest, the shooter may reduce recoil caused by firing the handgun. By reducing the recoil, the shooter may more easily return the handgun to a desired aiming orientation after firing and may more quickly re-acquire the aiming orientation so as to fire the handgun at an intended target.

While the thumbrest provides the foregoing advantages, there are a number of drawbacks associated with current models of the thumbrest, including at least the following limitations specified herein. Current models of the thumbrest require fabrication, alteration, or modification of a handgun holster, so that the handgun holster may accommodate the thumbrest. The handgun holster is generally developed to retain a particular model of the handgun; as such, incorporation of the thumbrest on the lateral side of the handgun frame often causes issues with withdrawal of the handgun from the handgun holster and insertion of the handgun into the handgun holster. Where the thumbrest has been incorporated onto the lateral side of the handgun frame, the thumbrest may protrude from the handgun, such that the thumbrest prohibits insertion into the handgun holster or withdrawal from the handgun holster. In some instances, completely open holsters must be utilized which are generally only practical for competition events.

In addition to drawbacks associated with the handgun holster, current models of the thumbrest do not have pivotability or movability; as such, the thumbrest, which receives the thumb of the non-trigger hand of the shooter, remains in a fixed position. Despite the advantages of the thumbrest with regard to control and recoil reduction, the shooter may not desire to use the thumbrest while firing the handgun. To avoid placement of the thumb of the non-trigger hand against the thumbrest, the shooter is confronted with at least two options: remove the thumbrest from the lateral side of the handgun frame or place the thumb of the non-trigger hand in an unconventional position along the handgun frame.

Thus, current models of the thumbrest present at least the following problems: the thumbrest may protrude from the hanging, prohibiting the shooter from inserting the handgun into the handgun holster or withdrawing the handgun from the handgun holster; the thumbrest remains in a fixed position, depriving the shooter of a choice as to whether the shooter should place the thumb of the non-trigger hand against the thumbrest, or alternatively, place the thumb of the non-trigger hand in a free position along the handgun frame. Thus, there is a need to provide a model of the thumbrest that overcomes the foregoing limitations.

BRIEF SUMMARY

The present disclosure provides a novel improvement device for a handgun. Specifically, the present disclosure provides a novel thumbrest for the handgun.

In light of the drawbacks of current models of a thumbrest, it would be desirable to provide a model of a thumbrest to overcome the limitations. The present disclosure provides a pivotable, or movable, thumbrest, wherein the pivotable thumbrest may pivot from a collapsed position, wherein the thumbrest is positioned adjacent to or alongside a lateral side of a handgun frame, to an extended position, wherein the thumbrest is positioned away from the lateral side of the handgun frame, such that a shooter may apply a thumb of a non-trigger hand against the thumbrest. The pivotable thumbrest enables the shooter not only to exert greater control over a handgun when the handgun is fired, but also would permit the shooter to insert the handgun into a handgun holster, without obstruction of the thumbrest and without the need to substantially modify or fabricate the handgun holster so that the handgun holster could accommodate or receive the handgun having the thumbrest.

In the context of a handgun, the handgun may include a handgun frame, a handgun grip, and a thumb support. The handgun frame may be defined as an exterior surface of the handgun. The handgrip may be attached to the handgun frame and may be configured to be gripped by a trigger hand of a shooter. The handgun frame may support the thumb support at a position adjacent to a lateral side of the handgun frame, the lateral side of the handgun frame opposite from a side where the shooter places the trigger hand. The thumb support may be pivotable relative to the handgun frame, pivoting between a collapsed position, wherein the thumb support may be folded up adjacent to, or in contact with, the lateral side of the handgun frame, and an extended position, wherein the thumb support may be pivoted away from the lateral side of the handgun frame. In the extended position, the thumb support may be configured such that a thumb of the non-trigger hand of the shooter may engage the thumb support, where the shooter applies a two-handed grip of the handgun.

In the context of a thumbrest for a handgun, the thumbrest may include a thumb support, a support base, and an elongated support member. The elongated support member, having a longitudinal axis, may be configured to replace a removable component of the handgun. The support base, being generally planar, may be fixed to an end of the elongated support member such that the support base extends generally orthogonal to the longitudinal axis of the elongated support member. The thumb support may be pivotable relative to the support base, pivoting between a collapsed position, wherein the thumb support may be folded up adjacent to, or in contact with, the support base, and an extended position, wherein the thumb support may be pivoted away from the support base.

In the context of a thumbrest for a handgun, the thumbrest may include a thumb support, a support base, a spring, and a stop structure. The support base may be configured for mounting or connection to the handgun. The thumb support may be pivotally attached to the support base, pivoting between a collapsed position, wherein the thumb support may be folded up adjacent to, or in contact with, the support base, and an extended position, wherein the thumb support may be pivoted away from the support base. The spring may be configured to bias the thumb support toward the extended position, wherein the thumb support may be pivoted away from the support base. The stop structure may be configured to limit pivotal movement of the thumb support, such that liming pivotal movement of the thumb support defines the extended position.

In one particular and exemplary optional embodiment, a handgun is provided, wherein the handgun comprises a handgun frame, a handgun grip, and a thumb support. The handgun grip is attached to the handgun frame and the handgun grip is configured to be gripped by a trigger hand of a shooter. The thumb support is supported from the handgun frame adjacent to a lateral side of the handgun frame opposite from the trigger hand of the shooter. The thumb support is pivotable relative to the handgun frame between a collapsed position, wherein the thumb support is folded up adjacent to the lateral side of the handgun frame, and an extended position, wherein the thumb support is pivoted away from the lateral side of the handgun frame. Further, the thumb support is configured in the extended position to be engaged by a thumb of a non-trigger hand of the shooter in a two-handed grip of the handgun.

In one aspect according to the above-referenced embodiment, where the thumb support is in the collapsed position, the thumb support may be in a range of 0 degrees to 10 degrees, measured with respect to the lateral side of the handgun frame. And, where the thumb support is in the extended position, the thumb support may be in a range of 70 degrees to 100 degrees, measured with respect to the lateral side of the handgun frame.

In another embodiment, the handgun may further comprise a spring configured to bias the thumb support to the extended position. The handgun may further comprise a stop structure configured to limit pivotal movement of the thumb support to define the extended position.

In another embodiment, the handgun may further comprise a hinge, the hinge configured to allow pivotable movement of the thumb support relative to the handgun frame.

In one aspect according to the above-referenced embodiment, the hinge may be tilted forward relative to an axis defined by a barrel of the handgun, such that the thumb support tilts forward relative to the barrel axis when the thumb support pivots to the extended position.

In one particular and exemplary embodiment, a thumbrest for a handgun is provided, wherein the thumbrest comprises a thumb support, a support base, and an elongated support member. The elongated support member is configured to replace a removable component of the handgun, the elongated member having a longitudinal axis. The support base is fixed to an end of the elongated support member, the support base being generally planar and extending generally orthogonally to the longitudinal axis of the elongated support member. Further, the thumb support is pivotable relative to the support base between a collapsed position, wherein the thumb support is folded up adjacent to the support base, and an extended position, wherein the thumb support is pivoted away from the support base.

In one aspect according to the above-referenced embodiment, the thumbrest may further comprise a spring and a stop structure, the spring configured to bias the thumb support toward the extended position, and the stop structure configured to limit pivotal movement of the thumb support to define the extended position.

In another embodiment, where the thumb support is in the collapsed position, the thumb support may be in a range of 0 degrees to 10 degrees, measured with respect to the support base. And, where the thumb support is in the extended position, the thumb support may be in a range of 70 degrees to 100 degrees, measured with respect to the support base.

In another embodiment, the thumbrest may further comprise a hinge, the hinge configured to allow pivotable movement of the thumb support relative to the support base.

In one aspect according to the above-referenced embodiment, the support base may include a sideplate extension extending substantially perpendicular relative to the longitudinal axis of the elongated support member, and the hinge may be tilted away from the sideplate extension, such that a pivot axis of the hinge forms an obtuse angle with the sideplate extension.

In another embodiment, the removable component of the handgun may be a slide lock, a disassembly lever, a takedown lever, an assembly, pin, or alternatively may be attached via attachment to the handgun's accessory rail. Alternatively, in some embodiments it could be attachable to various rails, channels, or attachment points of various firearms.

In another embodiment, the thumb support may be pivotable relative to the support base about a pivot axis. The thumb support may have a near edge and a far edge, the near edge proximate to the pivot axis and the far edge farther from the pivot axis than the near edge. The thumb support may include a raised lip along the far edge, and the support base may include a recess defined along an edge of the support base. The recessed edge may be configured to receive the raised lip when the thumb support pivots to the collapsed position.

In one particular and exemplary embodiment, a thumbrest for a handgun is provided, wherein the thumbrest comprises a thumb support, a support base, a spring, and a stop structure. The support base is configured for mounting to the handgun. The thumb support is pivotable relative to the support base between a collapsed position, wherein the thumb support is folded up adjacent to the support base, and an extended position, wherein the thumb support is pivoted away from the support base. The spring is configured to bias the thumb support toward the extended position, and the stop structure is configured to limit pivotable movement of the thumb support to define the extended position.

In one aspect according to the above-referenced embodiment, where the thumb support is in the collapsed position, the thumb support may be in a range of 0 degrees to 10 degrees, measured with respect to the support base. And, where the thumb support is in the extended position, the thumb support may be in a range of 70 degrees to 100 degrees, measured with respect to the support base.

In another embodiment, the thumbrest may further comprise a hinge, the hinge configured to allow pivotable movement of the thumb support relative to the support base.

In one aspect according to the above-referenced embodiment, the support base may include a sideplate extension extending along a sideplate extension axis, and the hinge is titled away from the sideplate extension such that a pivot axis of the hinge forms an obtuse angle with the sideplate extension axis.

In another embodiment, the thumb support may be pivotable relative to the support base about a pivot axis. And, the thumb support may have a thumb support length parallel to the pivot axis and the support base may have a support base length parallel to the pivot axis, wherein the support base length is shorter than the thumb support length.

In one aspect according to the above-referenced embodiment, the thumb support may have a thumb support width perpendicular to the pivot axis and the support base may have a support base width perpendicular to the pivot axis, where the support base width is shorter than the thumb support width.

In another embodiment, the thumb support may be pivotable relative to the support base about a pivot axis. And the thumb support may have a thumb support width perpendicular to the pivot axis and the support base may have a support base width perpendicular to the pivot axis, where the support base width is shorter than the thumb support width.

In another embodiment, the thumb support may be pivotable relative to the support base about a pivot axis. The thumb support may have a near edge and a far edge, the near edge proximate to the pivot axis and the far edge farther from the pivot axis than the near edge. The thumb support may include a raised lip along the far edge, and the support base may include a recess defined along an edge of the support base. The recessed edge may be configured to receive the raised lip when the thumb support pivots to the collapsed position.

Unless otherwise defined, all technical and scientific terms used herein have the same meaning as commonly understood by one of ordinary skill in the art to which this invention belongs. The present invention may be embodied in other specific forms without departing from the spirit or essential attributes thereof, and it is therefore desired that the present embodiment be considered in all aspects as illustrative and not restrictive. Any headings utilized in the description are for convenience only and no legal or limiting effect. Numerous objects, features, and advantages of the embodiments set forth herein will be readily apparent to those skilled in the art upon reading of the following disclosure when taken in conjunction with the accompanying drawings.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like, or any variation thereof, should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
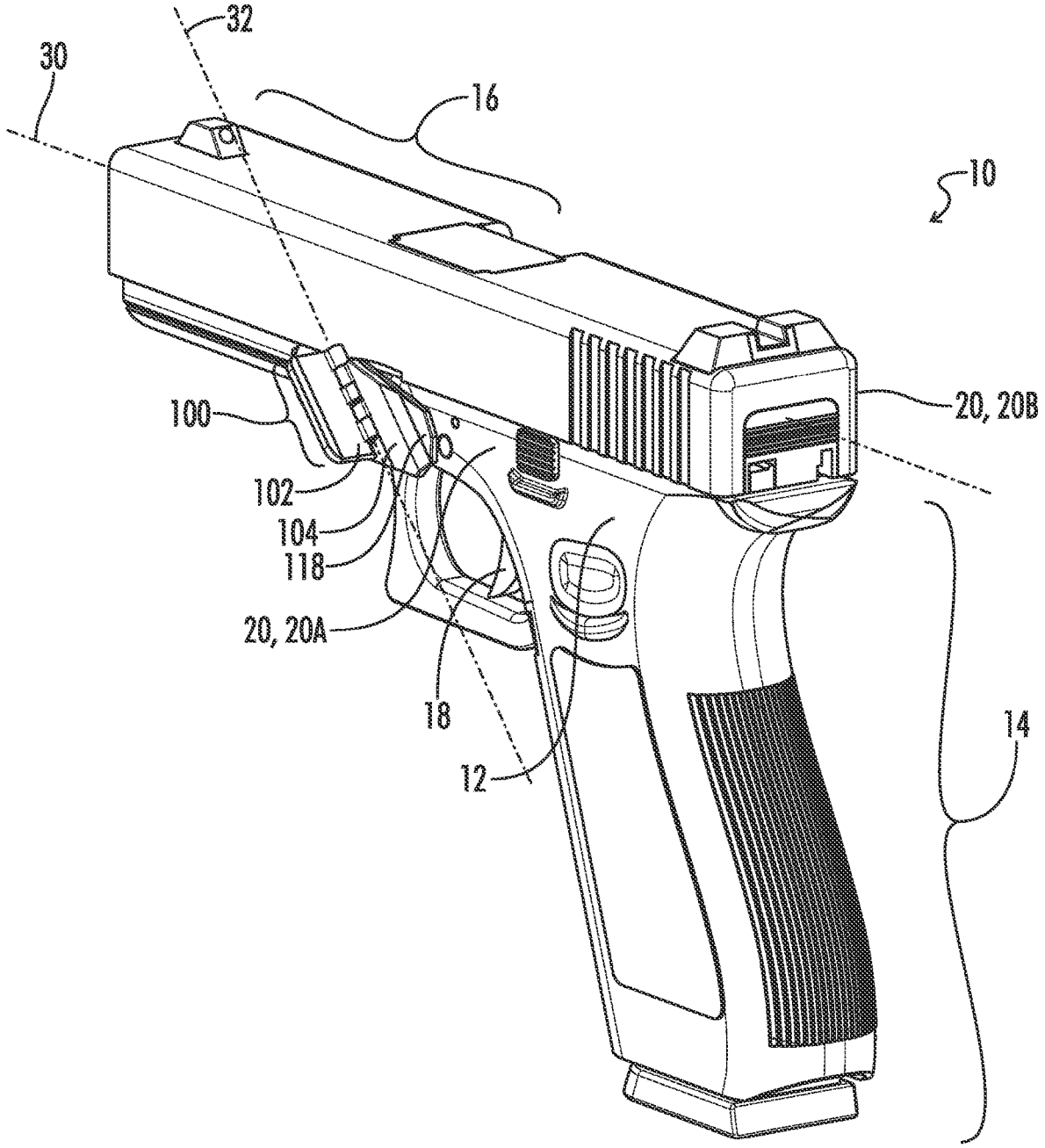
FIG. 1 is a perspective view of a handgun and a thumbrest, in accordance with the present disclosure.

Referring to FIG. 1, a handgun 10 is shown. The handgun 10 has a thumbrest 100 connected to a lateral side 20 of the handgun frame 12, the thumbrest having a thumb support 102 and a support base 104. The handgun 10 has a handgun frame 12, defined as an exterior surface of the handgun 10. The handgun includes a handgun barrel 16, extending along a handgun barrel axis 30, the handgun barrel 16 housed or contained within the handgun frame 12. A handgun grip 14 is attached to the handgun frame 12.

Figure 2:
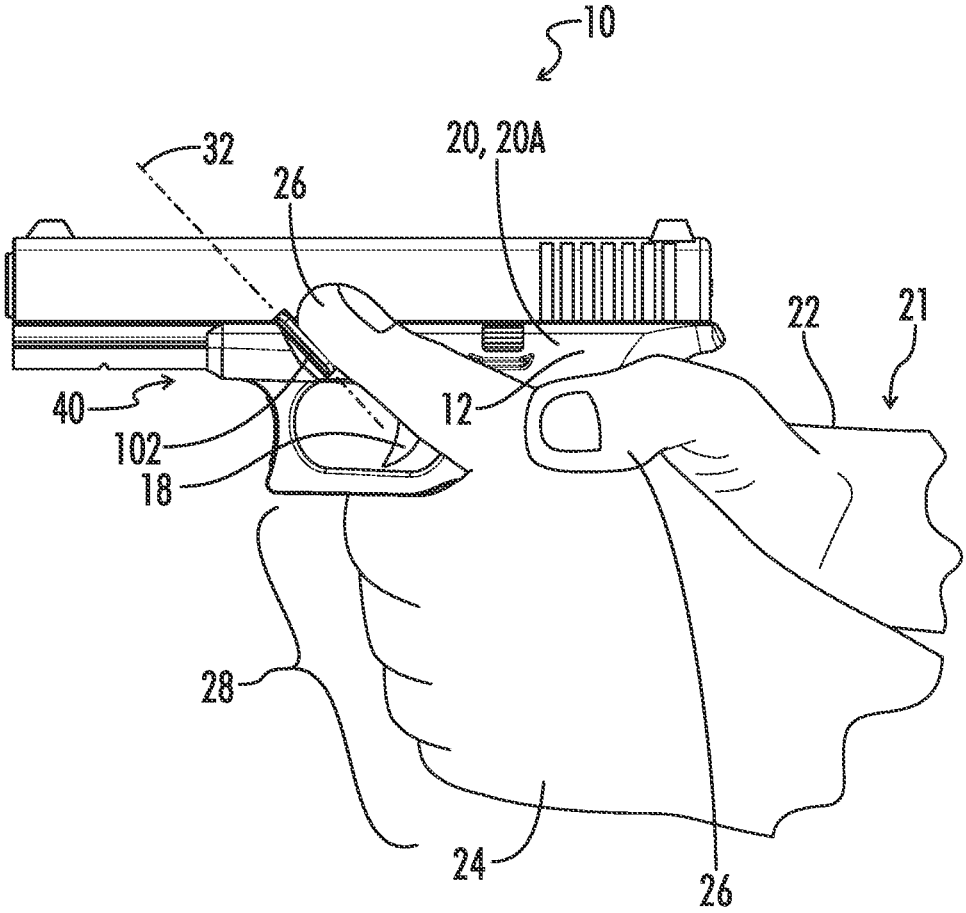
FIG. 2 is a perspective view of a handgun and a thumbrest, wherein a shooter engages the handgun with a two-handed grip, in accordance with the present disclosure.

Referring to FIG. 2, the handgun grip may be configured to be gripped by a trigger hand 22 of a shooter 21. A handgun trigger 18 is attached the handgun frame 12 and is configured to be pulled or released by the trigger hand 22 of the shooter 21. In gripping the handgun grip 14, the trigger hand 22 of the shooter 21 is configured to pull or release the handgun trigger 18.

In some embodiments, as depicted in FIG. 1, the thumb support 102 may be supported from the handgun frame 12 adjacent to the lateral side 20, the lateral side 20 being opposite from the trigger hand 22. As illustrated FIG. 1, the lateral side 20 may constitute either a left lateral side 20A or a right lateral side 20B. In other embodiments, the thumb support 102 may be supported from the support base 104 mounted to the lateral side 20 of the handgun 10, the thumb support 102 being adjacent to the lateral side 20, the lateral side 20 being opposite from the trigger hand 22.

In some embodiments, as depicted in FIGS. 3A-3D, the thumb support 102 may be pivotable relative to the handgun frame 12 about a pivot axis 32, such that the thumb support 102 pivotably moves between a collapsed position 44, wherein the thumb support 102 is folded up adjacent to, in contact with, or proximate to the lateral side 20, and an extended position 40, wherein the thumb support 102 is pivoted away from the lateral side 20. The lateral side 20 may constitute either a left lateral side 20A or a right lateral side 20B. In optional embodiments, in the collapsed position 44, the thumb support 102 may have a range 46 of 0 degrees to 10 degrees, measured with respect to the lateral side 20. In the extended position, the thumb support 102 may have a range 48 of 70 degrees to 100 degrees, measured with respect to the lateral side 20.

In other embodiments, as depicted in FIGS. 3A-3D and 5A-5C, the thumb support 102 may be pivotable relative to the support base 104 about a pivot axis 32, such that the thumb support 102 pivotably moves between the collapsed position 44, wherein the thumb support 102 is folded up adjacent to, in contact with, or proximate to the support base 104, and the extended position 40, wherein the thumb support 102 is pivoted away from the support base 104. In optional embodiments, and as further depicted in FIGS. 5A-5C, in the collapsed position 44, the thumb support 102 may have the range 46 of 0 degrees to 10 degrees, measured with respect to the support base 104. In the extended position, the thumb support 102 may have the range 48 of 70 degrees to 100 degrees, measured with respect to the support base 104.

Referring to FIG. 2, in the extended position 40, the thumb support 102 may be configured to be engaged by a thumb 26 of a non-trigger hand 24 of the shooter 21. The thumb support 102 may be configured to be engaged by the thumb 26 of the non-trigger hand 24 of the shooter 21, where the shooter 21 applies a two-handed grip 28 of the handgun 10.

The shooter 21 may apply the two-handed grip 28 of the handgun 10. In applying the two-handed grip 28 of the handgun 10, the shooter 21 grips the handgun grip 14 with the trigger hand 22. In gripping the handgun grip 14, the trigger hand 22 of the shooter 21 may pull or release the handgun trigger 18. The thumb support 102 may be pivoted to the extended position 40, such that the thumb support 102 may be engaged by the thumb 26 of the non-trigger hand 24 of the shooter 21. In engaging the thumb support 102 with the thumb 26 of the non-trigger hand 24, the shooter 21 may apply a force against the thumb support 102 through the thumb 26, thereby improving grip and reducing recoil of the handgun 10 when the shooter 21 fires the handgun 10.

Figure 3A:
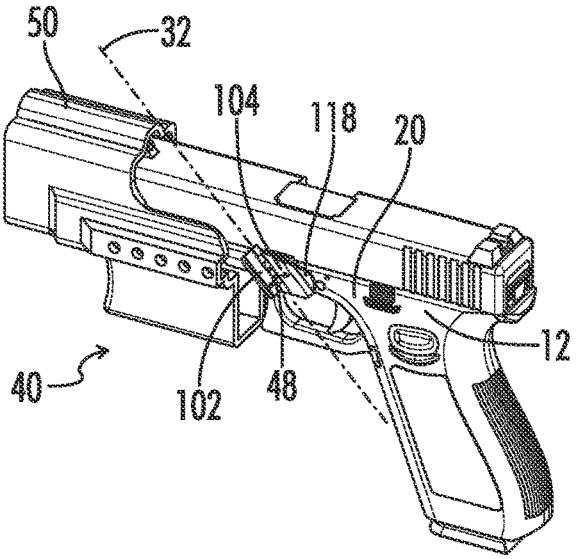
FIG. 3A is a perspective view of a handgun and a thumbrest, wherein the handgun is fully withdrawn from a handgun holster, in accordance with the present disclosure.

FIGS. 3A-3D depict withdrawal of the handgun 10 from a handgun holster 50 and insertion of the handgun 10 into the handgun holster 50. In FIG. 3A, the handgun 10 is fully withdrawn from the handgun holster 50, such that the thumb support 102 is pivotably moved to the extended position 40, wherein the thumb support 102 is pivoted away from the support base 104, thereby enabling the shooter 21 to engage the thumb support 102 with the thumb 26 of the non-trigger hand 24. In optional embodiments, the handgun 10 is fully withdrawn from the handgun holster 50, such that the thumb support 102 is pivotably moved to the extended position 40, wherein the thumb support 102 is pivoted away from the lateral side 20, thereby enabling the shooter 21 to engage the thumb support 102 with the thumb 26 of the non-trigger hand 24. In optional embodiments, and as further depicted in FIGS. 5A-5C, in the extended position 40, the thumb support 102 may have the range 48 of 70 degrees to 100 degrees, measured with respect to the support base 104 or the lateral side 20.

Figure 3B:
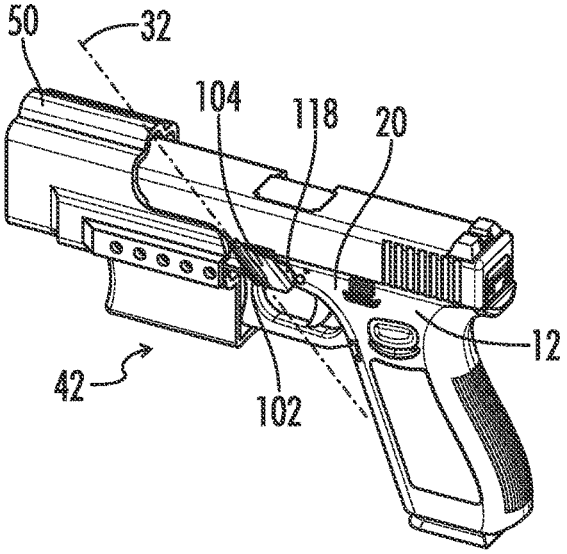
FIG. 3B is a perspective view of the handgun and the thumbrest, wherein the handgun is partially withdrawn from the handgun holster, in accordance with the present disclosure.

In FIG. 3B, the handgun 10 is partially withdrawn the handgun holster 50, such that the thumb support 102 is pivotably moved to an intermediate position 42, wherein the thumb support 102 is moved between the extended position 40 and the collapsed position 44.

Figure 3C:
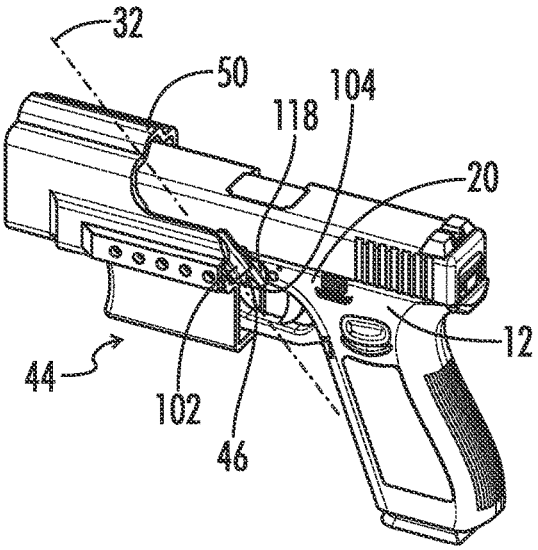
FIG. 3C is a perspective view of the handgun and the thumbrest, wherein the handgun is partially inserted into the handgun holster, in accordance with the present disclosure.

In FIG. 3C, the handgun 10 is partially inserted into the handgun holster 50, such that the thumb support 102 is pivotably moved to the collapsed position 44, wherein the thumb support 102 is folded up adjacent to, in contact with, or proximate to the support base 104. In optional embodiments, the thumb support may be pivotably moved to the collapsed position 44, wherein the thumb support 102 is folded up adjacent to, in contact with, or proximate to the lateral side 20. In optional embodiments, and as further depicted in FIGS. 5A-5C, in the collapsed position 44, the thumb support 102 may have the range 46 of 0 degrees to 10 degrees, measured with respect to the support base 104 or the lateral side 20. In the collapsed position 44, the handgun 10 may be easily inserted into or withdrawn from the handgun holster 50, such that the thumb support 102 does not obstruct withdrawal or insertion of the handgun 10 with respect to the handgun holster 50.

Figure 3D:
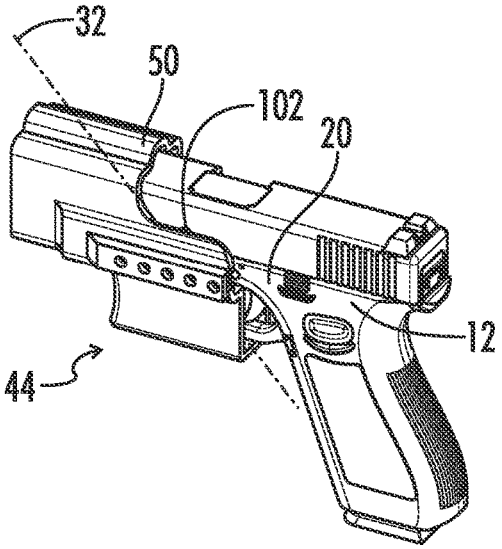
FIG. 3D is a perspective view of the handgun and the thumbrest, wherein the handgun is fully inserted into the handgun holster and concealed by the handgun holster, in accordance with the present disclosure.

In FIG. 3D, the handgun 10 is fully inserted into the handgun holster 50, such that the thumbrest 100 is concealed by the handgun holster 50. While concealed by the handgun holster 50, the thumb support 102 remains in the collapsed position 44, wherein the thumb support is folded up adjacent to, in contact with, or proximate to the support base 104 or the lateral side 20. In some embodiments, the handgun holster 50 need not be significantly altered, customized, specially fabricated, or otherwise significantly modified with receptables, grooves, pockets, or other channels to receive the thumbrest 100, as the thumb support 102, in the collapsed position 44, is adjacent to, in contact with, or proximate to the support base 104 and/or the lateral side 20, such that it the thumbrest minorly protrudes the lateral side 20 of the handgun frame 12.

Figure 4A:
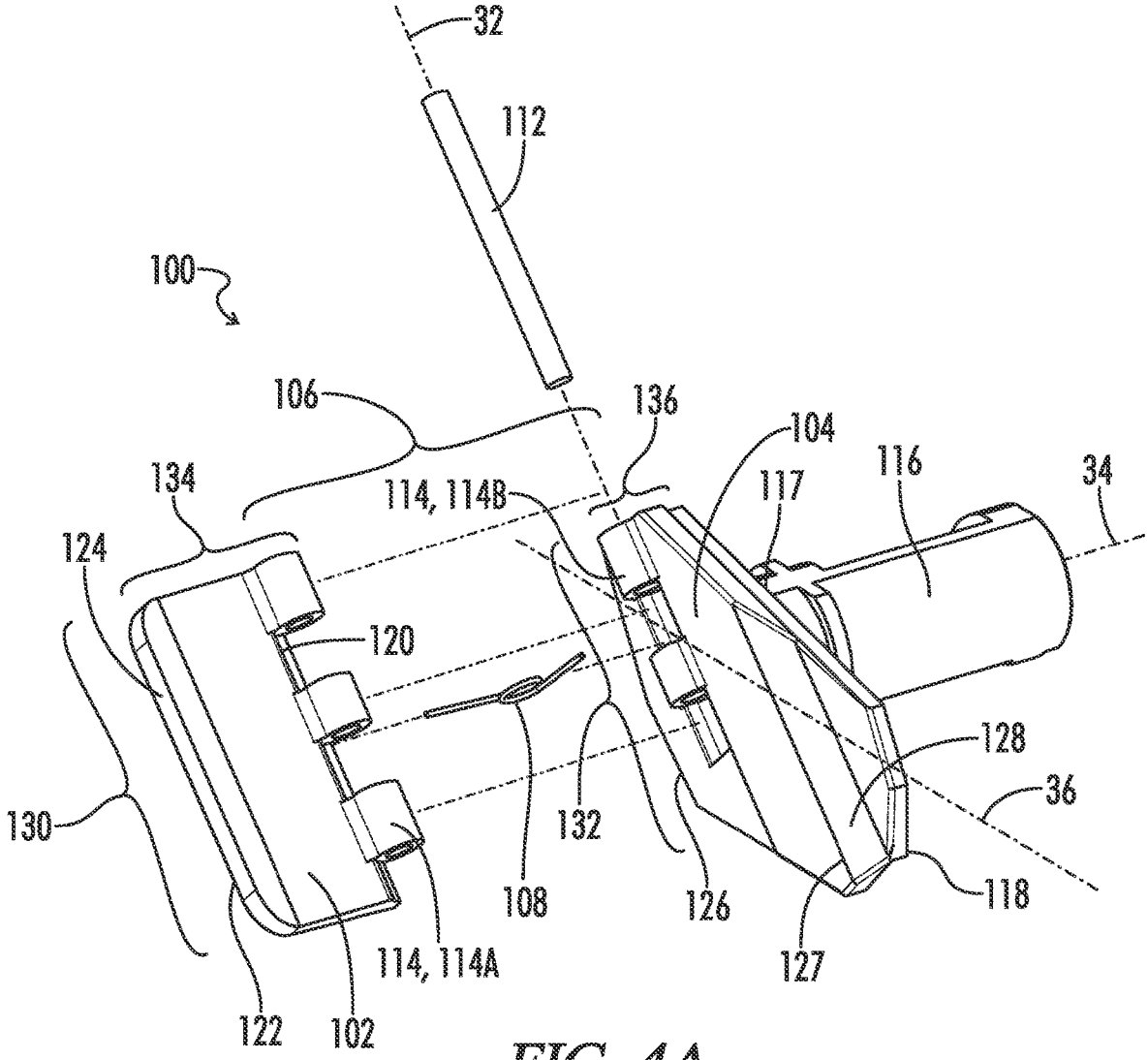
FIG. 4A is an exploded perspective view a thumbrest, in accordance with the present disclosure.

Referring to FIG. 4A, the thumbrest 100 includes the thumb support 102 and the support base 104. The thumb support 102 is pivotable relative to the support base 104 about the pivot axis 32 between the collapsed position 44, wherein the thumb support 102 is folded up adjacent to, in contact with, or proximate to the support base 104, and the extended position 40, wherein the thumb support 102 is pivoted away from the support base 104, as depicted in FIGS. 3A-3D and FIGS. 5A-5C. Referring to FIG. 4A, the thumb support 102 has a near edge 120 and a far edge 122, the near edge 120 proximate to the pivot axis 32, and the far edge 122 farther from the pivot axis 32 than the near edge 120. The support base has a near edge 126 and a far edge 127, the near edge 126 proximate to the pivot axis 32, and the far edge 127 farther from the pivot axis 32 than the near edge 126.

In some embodiments, the thumb support 102 may have a thumb support length 130 parallel to the pivot axis 32, and the support base 104 may have a support base length 132 parallel to the pivot axis 32. The support base length 132 may be shorter than the thumb support length 130.

In other embodiments, the thumb support 102 may have a thumb support width 134 perpendicular to the pivot axis 32, and the support base 104 may have a support base width 136. The support base width 136 may be shorter than the thumb support width 134.

In some embodiments, the thumb support 102 may include a raised lip 124, defined along the far edge 122 of the thumb support 102. Moreover, the support base 104 may include a recess 128, defined along the far edge 127 of the support base 104. The recessed edge 128 may be configured to receive the raised lip 124 when the thumb support 102 pivots about the pivot axis 32 to the collapsed position 44, such that the thumb support 102 is folded up adjacent to, in contact with, or proximate to the support base 104. When the recessed edge 128 receives the raised lip 124 when the thumb support 102 pivots about the axis 32 to the collapsed position 44, the recessed edge 128 and the raised lip 124 may be stably aligned.

Figure 4B:
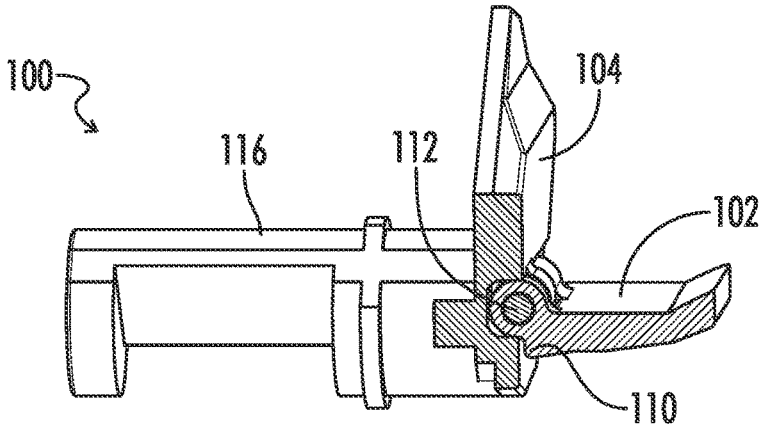
FIG. 4B is a top-down perspective view of the thumbrest, in accordance with the present disclosure.

In some embodiments, as depicted in FIGS. 4A-4B, the thumbrest 100 may further include a spring 108 and a stop structure 110. The spring 108 may be configured to bias the thumb support 102 toward the extended position 40, and the stop structure 110 may be configured to limit pivotal movement of the thumb support 102, such that limiting pivotal movement of the thumb support 102 defines the extended position 40. In effect, the stop structure 110 prevents the thumb support 102 from pivotably moving beyond the extended position 40. As shown in FIG. 4B, the stop structure 110 may be a physical protrusion or an abutment of a back side of the thumb support 102, where the stop structure 110 prohibits the thumb support 102 from pivotably moving beyond the extended position 40. In other embodiments, the stop structure 110 may be the physical protrusion or the abutment of the support base 104, where the stop structure prohibits the thumb support 102 from pivotably moving beyond the extended position 40. In optional embodiments, the stop structure may be a hinge stop positioned between one or more interconnecting loops 114, such that the pin 110 is inserted through the one or more interconnecting loops 114 and the stop structure 110.

By maintaining the thumb support 102 at the extended position 40, the stop structure 110 enables the shooter 21 to apply the thumb 26 of the non-trigger hand 24, so as to promote control of the handgun 10 and reduce recoil or kickback from the handgun 10 when the handgun 10 is fired by the shooter 21. Pivotably moving the thumb support 102 beyond the extended position 40 could compromise control of the handgun 10, when fired by the shooter 21, as the shooter 21 would not be permitted to effectively apply a force against the thumb support 102 through the thumb 26 of the non-trigger hand 24.

Referring to FIG. 4A, in some embodiments, the thumbrest 100 may further comprise a hinge 106, the hinge 106 configured to allow or enable pivotal movement of the thumb support 102 relative to the support base 104, between the collapsed position 44, wherein the thumb support 102 is folded up adjacent to, in contact with, or proximate to the support base 104, and the extended position 40, wherein the thumb support 102 is pivoted away from the support base 104. The hinge 106 may include a pin 112 and the one or more interconnecting loops 114. As illustrated, the one or more interconnecting loops 114 defined along the near edge 120 of the thumb support 102 constitutes one or more interconnecting loops 114A, and the one or more interconnecting loops 114 defined along the near edge 126 of the thumb support 102 constitutes one or more interconnecting loops 114B. The one or more interconnecting loops 114A may be offset from the one or more interconnecting loops 114B, such that the one or more interconnecting loops 114A and the one or more interconnecting loops 114B are aligned the pivot axis 32. The pin 112 may be inserted through an alignment of the one or more interconnecting loops 114A and the one or more interconnecting loops 114B about pivot axis 32, such that the pin 112 maintains a pivotal connection of the thumb support 102 and the support base 104.

In other embodiments, the support base 104 may include a sideplate extension 118 extending along a sideplate extension axis 36. The hinge 106 may be tilted away from the sideplate extension 118, such that the pivot axis 32, extending through the hinge 106, forms an obtuse angle with respect to the sideplate extension axis 36. Such obtuse angle of the pivot axis 32, with respect to the sideplate extension axis 36, may be in the range of 100 degrees to 150 degrees.

Referring to FIG. 4A, in some embodiments, an elongated support member 116 may be configured to replace a removable component of the handgun 10. The elongated support member 116 may have a longitudinal axis 34 in an orientation orthogonal to the support base 104. The support base 104 may be mounted, fixed, or otherwise connected to an end 117 of the elongated support member 116. The support base 104 may have a generally planar shape or orientation, and the support base 104 may extend generally in an orientation orthogonal to the longitudinal axis 34 of the elongated support member 116.

In other embodiments, the thumbrest 100 may further comprise the hinge 106, the hinge 106 configured to allow pivotable movement of the thumb support 102 relative to the support base 104. The support base 104 may further include the sideplate extension 118, the sideplate extension 118 extending in a perpendicular orientation with respect to the longitudinal axis 34 of the elongated support member 116. The hinge 106 may be tilted away from the sideplate extension 118, such that the pivot axis 32, extending through the hinge 106, forms an obtuse angle with respect to the sideplate extension axis 36 of the sideplate extension 118. Such obtuse angle of the pivot axis 32, with respect to the sideplate extension axis 36, may be in the range of 100 degrees to 150 degrees.

Figure 6A:
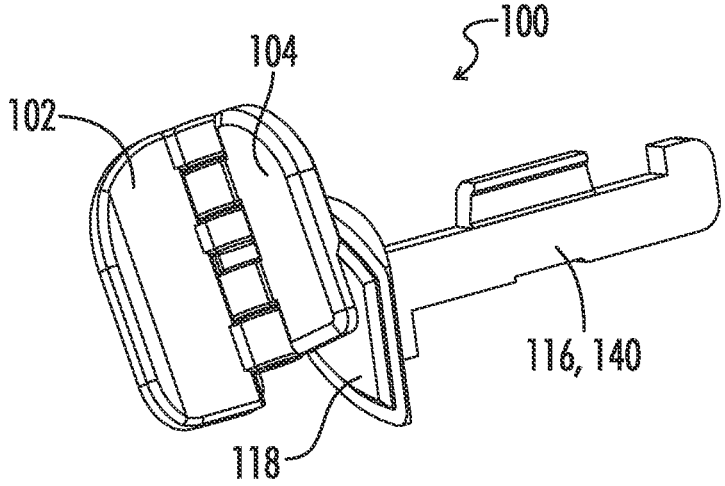
FIG. 6A is a perspective view of an embodiment of a thumbrest, wherein an elongated support member is configured to replace a removable component of a handgun, in accordance with the present disclosure.
Figure 6B:
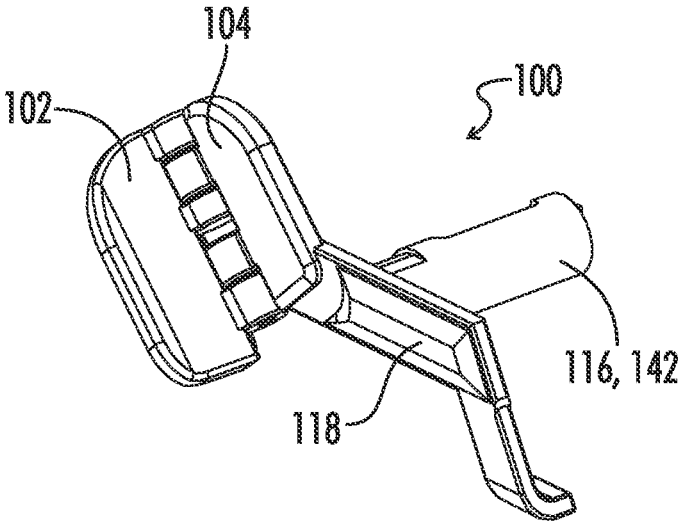
FIG. 6B is a perspective view of another embodiment of the thumbrest, wherein the elongated support member is configured to replace the removable component of the handgun, in accordance the present disclosure.
Figure 6C:
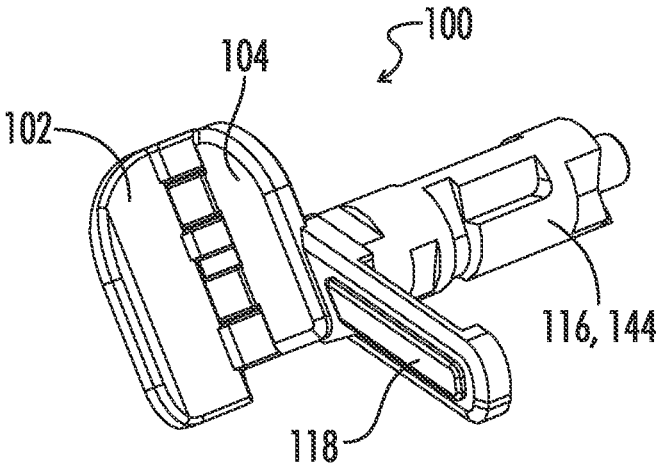
FIG. 6C is a perspective view of a further embodiment of the thumbrest, wherein the elongated support member is configured to replace the removable component of the handgun, in accordance with the present disclosure.

In some embodiments, the elongated support member 116 may be configured to replace a removable component of the handgun 10. Such removable component of the handgun 10 may be a slide lock 140, as depicted in FIG. 6A, a disassembly lever 142, as depicted in FIG. 6B, or a takedown lever 144, as depicted in FIG. 6C. The elongated support member 116 may be configured to replace other removable components of the handgun 10, including, but not limited to pins, take down levers, slide lock components, and the like. Additionally, in some optional embodiments, the thumbrest 100 may be attachable to rails, channels or other attachment points of firearms. In replacing the removable component of the handgun 10 with the elongated support member 116, the thumbrest 100 may be configured to be mounted, supported from, affixed to, or connected to the handgun 10 without affixing the thumbrest 100 to the handgun 10 vis-à-vis smithing, welding, or fastening. Thus, the elongated support member 116 may not require the fabrication, modification, or alteration of the handgun 10 or the handgun frame 12 in mounting, connecting, supporting, or affixing the thumbrest 100.

Figure 5A:
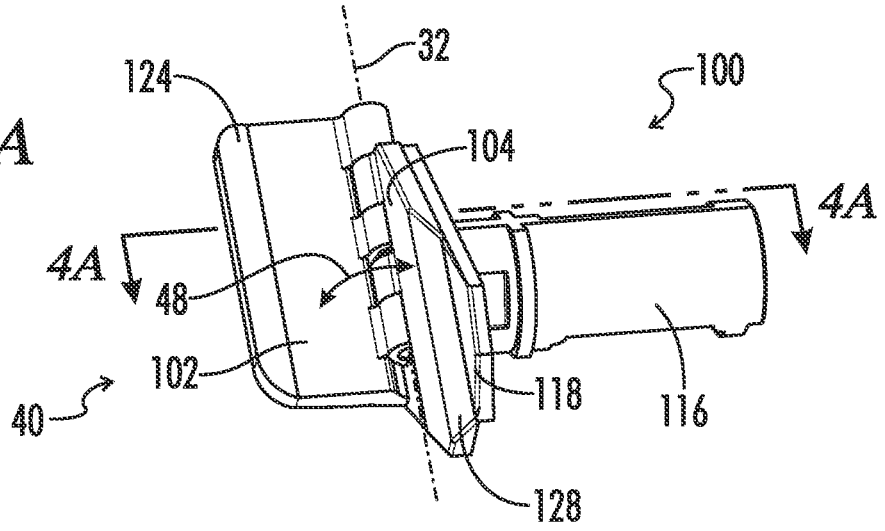
FIG. 5A is a perspective view of a thumbrest, wherein a thumb support moves to an extended position, in accordance with the present disclosure.
Figure 5B:
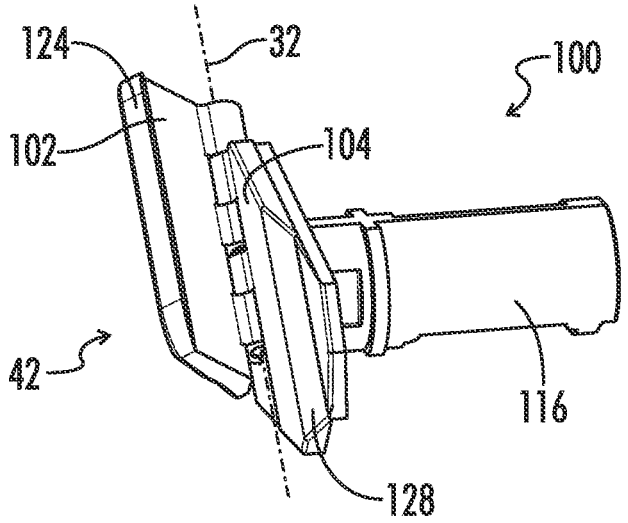
FIG. 5B is a perspective view the thumbrest, wherein the thumb support moves to an intermediate position, in accordance with the present disclosure.
Figure 5C:
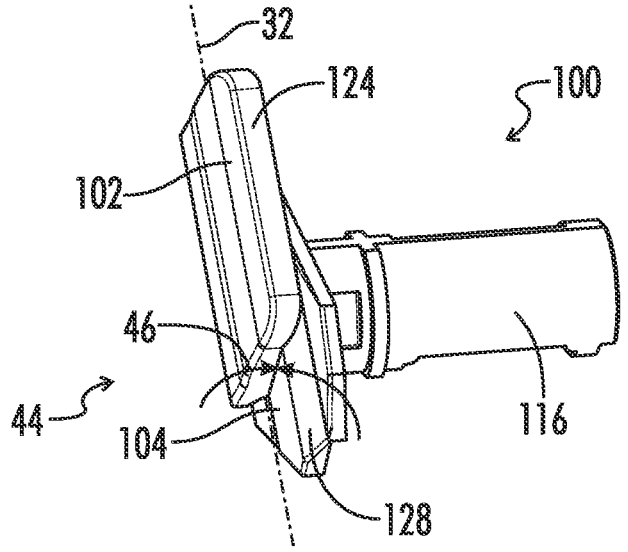
FIG. 5C is a perspective view of the thumbrest, wherein the thumb support moves to a collapsed position, in accordance with the present disclosure.

Referring to FIGS. 5A-5C, the thumb support 102 is depicted in a series of positions through the pivotal movement of the thumb support 102 about the pivot axis 32: the extended position 40, the intermediate position 42, and the collapsed position. In FIG. 5A, the thumb support 102, being pivotable about the pivot axis 32, is pivotably moved to the extended position 40, wherein the thumb support 102 is pivoted away from the support base 104. In the extended position 40, the thumb support 102 may be configured to be engaged by the thumb 26 of the non-trigger hand 24 of the shooter 21. In some embodiments, in the extended position 40, the thumb support 102 may have the range 48 of 70 degrees to 100 degrees, measured with respect to the support base 104. In FIG. 5B, the thumb support 102, being pivotable about the pivot axis 32, is pivotably moved to the intermediate position 42, the intermediate position 42 constituting a position between the extended position 40 and the collapsed position 44. In the intermediate position 42, the thumb support 102 is generally not configured to be engaged by the thumb 26 of the non-trigger hand 24 of the shooter 21.

In FIG. 5C, the thumb support 102, being pivotable about the pivot axis 32, is pivotably moved to the collapsed position 44, wherein the thumb support 102 is folded up adjacent to, in contact with, or proximate to the support base 104. In the collapsed position 44, the thumb support 102 is generally not configured to be engaged by the thumb 26 of the non-trigger hand 24 of the shooter 21. The collapsed position 44 enables the shooter 21 to insert the handgun 10, to which the thumbrest 100 is mounted, connected, affixed, or otherwise attached, into the handgun holster 50. In some embodiments, in the collapsed position 44, the thumb support may have the range 46 of 0 degrees to 10 degrees, measured with respect to the support base 104. In other embodiments, the thumb support 102 may include the raised lip 124, defined along the far edge 122 of the thumb support 102. Moreover, the support base 104 may include the recess 128, defined along the far edge 127 of the support base 104. The recessed edge 128 may be configured to receive the raised lip 124 when the thumb support 102 pivots about the pivot axis 32 to the collapsed position 44. When the recessed edge 128 receives the raised lip 124, the recessed edge 128 and the raised lip 124 may be stably aligned.

Referring to FIGS. 6A-6C, the elongated support member 116 may be configured to replace the removable component of the handgun 10. In replacing the removable component of the handgun 10 with the elongated support member 116, the thumbrest 100 may be configured to be mounted, supported from, affixed to, or connected to the handgun 10 without affixing the thumbrest 100 to the handgun 10 vis-à-vis smithing, welding, or fastening. Thus, the elongated support member 116 may not require the fabrication, modification, or alteration of the handgun 10 or the handgun frame 12 in mounting, connecting, supporting, or affixing the thumbrest 100.

FIGS. 6A-6C depict exemplary embodiments of the thumbrest 100, wherein the elongated support member 116 replaces the removable component of the handgun 10. The embodiments in FIGS. 6A-6C are merely representative, and do not flag, signal, or indicate the universe of removable components of the handgun 10. In FIG. 6A, the elongated support member 116 replaces the removable component of the handgun 10, wherein the removable component may be slide lock 140. The slide lock 140 may be a removable component of various handguns models. In FIG. 6B, the elongated support member replaces the removable component of the handgun 10, wherein the removable component of the handgun may be the disassembly lever 142. The disassembly lever 142 may be the removable component of the following of various handguns, one non-limiting example being the HK VP9. In FIG. 6C, the elongated support member replaces the removable component of the handgun 10, wherein the removable component of the handgun may be the takedown lever 144. The takedown lever may be the removable component of various handguns, a non-limiting example being a Sig Sauer P365.

FIGS. 6A-6C depict a limited number of embodiments where the elongated support member 116 is configured to replace the removable component of the handgun 10. The elongated support member 116 may be configured to replace any removable component of the handgun 10. The removable component of the handgun 10, and a corresponding model of the handgun 10 having the removable component, may include, but are not limited to viable removable components from handguns which still allow the handgun to be functional while allowing for the integration of the thumbrest with the firearm.

In additional optional embodiments, the thumbrest may include attachments structures for attaching to accessory rails or the like. In some embodiments, the thumbrest may include M-LOK, KEYMOD, or Picatinny attachments for attaching to various rail sections. In some optional embodiments, the thumbrest may be attachable to other firearms, such as rifles and shotguns.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful HANDGUN IMPROVEMENT DEVICE, it is not intended that such references be construed as limitations upon the scope of this disclosure except as set forth in the following claims.

What is claimed is:

1. A handgun, the handgun comprising:

a handgun frame;

a handgun grip attached to the handgun frame and configured to be gripped by a trigger hand of a shooter;

a thumbrest including a thumb support and support base, the thumbrest supported from the handgun frame adjacent to a lateral side of the handgun frame opposite from the trigger hand of the shooter, the thumbrest configured to replace a removable component of the handgun;

the thumb support pivotable relative to the handgun frame between a collapsed position wherein the thumb support is folded up adjacent to the lateral side of the handgun frame and an extended position wherein the thumb support is pivoted away from the lateral side of the handgun frame; and the thumb support configured in the extended position to be engaged by a thumb of a non-trigger hand of the shooter in a two-handed grip of the handgun.

2. The handgun of claim 1, wherein:

in the collapsed position the thumb support is in a range of 0 degrees to 10 degrees measured with respect to the lateral side of the handgun frame; and in the extended position the thumb support is in a range of 70 degrees to 100 degrees measured with respect to the lateral side of the handgun frame.

3. The handgun of claim 1, further comprising:

a spring configured to bias the thumb support toward the extended position; and a stop structure configured to limit pivotal movement of the thumb support to define the extended position.

4. The handgun of claim 1, further comprising:

a hinge configured to allow pivotable movement of the thumb support relative to the handgun frame.

5. A thumbrest configured for a handgun, the thumbrest comprising:

a thumb support and a support base;

an elongated support member configured to replace a removable component of the handgun, the elongated support member having a longitudinal axis;

the support base fixed to an end of the elongated support member, the support base being generally planar and extending generally orthogonally to the longitudinal axis of the elongated support member; and the thumb support pivotable relative to the support base between a collapsed position wherein the thumb support is folded up adjacent to the support base and an extended position wherein the thumb support is pivoted away from the support base.

6. The thumbrest of claim 5, further comprising:

a spring configured to bias the thumb support toward the extended position; and a stop structure configured to limit pivotal movement of the thumb support to define the extended position.

7. The thumbrest of claim 5, wherein:

in the collapsed position the thumb support is located in a range of 0 degrees to 10 degrees measured with respect to the support base; and in the extended position the thumb support is located in a range of 70 degrees to 100 degrees measured with respect to the support base.

8. The thumbrest of claim 5, further comprising:

a hinge configured to allow pivotable movement of the thumb support relative to the support base.

9. The thumbrest of claim 8, wherein:

the support base includes a sideplate extension extending substantially perpendicular relative to the longitudinal axis of the elongated support member; and the hinge is tilted away from the sideplate extension so that a pivot axis of the hinge forms an obtuse angle with the sideplate extension.

10. The thumbrest of claim 5, wherein:

the removable component of the handgun is a slide lock, a disassembly lever, or a takedown lever.

11. A thumbrest configured for a handgun, the thumbrest comprising:

a support base configured for mounting to the handgun;

a thumb support pivotable relative to the support base between a collapsed position wherein the thumb support is folded up adjacent to the support base and an extended position wherein the thumb support is pivoted away from the support base;

a spring configured to bias the thumb support toward the extended position; and a stop structure configured to limit pivotal movement of the thumb support to define the extended position;

wherein the thumbrest is configured to replace a removable component of the handgun.

12. The thumbrest of claim 11, wherein:

in the collapsed position the thumb support is located in a range of 0 degrees to 10 degrees measured with respect to the support base; and in the extended position the thumb support is located in a range of 70 degrees to 100 degrees measured with respect to the support base.

13. The thumbrest of claim 11, further comprising:

a hinge configured to allow pivotable movement of the thumb support relative to the support base.

14. The thumbrest of claim 13, wherein:

the support base includes a sideplate extension extending along a sideplate extension axis; and the hinge is tilted away from the sideplate extension so that a pivot axis of the hinge forms an obtuse angle with the sideplate extension axis.

15. The thumbrest of claim 11, wherein:

the thumb support is pivotable relative to the support base about a pivot axis;

the thumb support has a thumb support length parallel to the pivot axis and the support base has a support base length parallel to the pivot axis; and the support base length is shorter than the thumb support length.

16. The thumbrest of claim 15, wherein:

the thumb support has a thumb support width perpendicular to the pivot axis and the support base has a support base width perpendicular to the pivot axis; and the support base width is shorter than the thumb support width.

17. The thumbrest of claim 11, wherein:

the thumb support is pivotable relative to the support base about a pivot axis;

the thumb support has a thumb support width perpendicular to the pivot axis and the support base has a support base width perpendicular to the pivot axis; and the support base width is shorter than the thumb support width.

18. The handgun of claim 1, wherein:

in the extended position the thumb support is non-planar relative to the support base.

19. The thumbrest of claim 5, wherein:

in the extended position the thumb support is non-planar relative to the support base.

20. The thumbrest of claim 11, wherein:

in the extended position the thumb support is non-planar relative to the support base.

* * * * *